US009399475B2

(12) United States Patent
Roudiere et al.

(10) Patent No.: US 9,399,475 B2
(45) Date of Patent: Jul. 26, 2016

(54) PASSIVE STEERING ASSIST DEVICE FOR A MONORAIL BOGIE

(75) Inventors: Cesar Victor Benoist Roudiere, Montreal (CA); Christian Roy, Montreal (CA); Mario Monette, Carignan (CA); Louis Thibault, St-Hyacinthe (CA)

(73) Assignee: Bombardier Transportation GmbH, Berlin (DE)

( * ) Notice: Subject to any disclaimer, the term of this patent is extended or adjusted under 35 U.S.C. 154(b) by 93 days.

(21) Appl. No.: 14/361,506

(22) PCT Filed: Nov. 30, 2011

(86) PCT No.: PCT/CA2011/001324

§ 371 (c)(1),
(2), (4) Date: May 29, 2014

(87) PCT Pub. No.: WO2013/078527

PCT Pub. Date: Jun. 6, 2013

(65) Prior Publication Data

US 2014/0261063 A1 Sep. 18, 2014

(51) Int. Cl.
*B61F 5/38* (2006.01)
*B61B 13/04* (2006.01)

(52) U.S. Cl.
CPC .. *B61F 5/38* (2013.01); *B61B 13/04* (2013.01)

(58) Field of Classification Search
CPC ..... B61F 3/00; B61F 5/00; B61F 5/02; B61F 5/04; B61F 5/38; B61F 5/46; B61F 5/50
USPC ..... 105/141, 144, 157.1, 165, 167, 168, 105/182.1, 194
See application file for complete search history.

(56) References Cited

U.S. PATENT DOCUMENTS

| | | | | |
|---|---|---|---|---|
| 3,017,838 | A | 1/1962 | Bingham | |
| 3,095,828 | A | 7/1963 | Deller | |
| 3,143,977 | A | 8/1964 | Deller | |
| 2009/0236823 | A1 * | 9/2009 | Prem | B62D 13/005 280/426 |

FOREIGN PATENT DOCUMENTS

| | | | | |
|---|---|---|---|---|
| CA | 2708885 | * | 4/2010 | B61B 13/04 |
| CA | 2708885 | A1 | 10/2010 | |
| WO | WO2011044652 | A1 | 4/2011 | |

* cited by examiner

*Primary Examiner* — R. J. McCarry, Jr.
(74) *Attorney, Agent, or Firm* — The Webb Law Firm

(57) ABSTRACT

A traction control assembly for connection between a monorail bogie frame and a monorail car. The traction control assembly comprising a first traction link pivotally connected to a first bell crank mechanism and a second traction link pivotally connected to a second bell crank mechanism. The first traction link and the second traction link are capable of absorbing traction forces applied to the monorail bogie. The traction control assembly further comprises a cross link interconnecting the first bell crank mechanism and the second bell crank mechanism and a passive steering assist device interconnecting the first bell crank mechanism and the second bell crank mechanism. The steering assist device causes the traction control assembly to insert shear forces on the monorail bogie during travel of the monorail bogie over a curved section of monorail track for facilitating rotational motion between the monorail bogie and the monorail car.

23 Claims, 7 Drawing Sheets

PASSIVE STEERING ASSIST DEVICE FOR A MONORAIL BOGIE

CROSS-REFERENCE TO RELATED APPLICATION

This application is the United States national phase of International Application No. PCT/CA2011/001324 filed Nov. 30, 2011, the disclosure of which is hereby incorporated in its entirety by reference.

FIELD OF THE INVENTION

The present invention relates to the field of monorail bogies for supporting monorail cars, and more specifically, to monorail bogies that comprise a steering assist device for more evenly distributing the load applied to the monorail guide wheels while in curves in the monorail track.

BACKGROUND OF THE INVENTION

Monorail bogies for supporting monorail cars are known in the art and are used in many monorail car assemblies for supporting the running wheels and guide wheels beneath the monorail cars.

Many monorail bogies support load bearing wheels that travel on the upper surface of the monorail track and guide wheels that travel along the side surfaces of the monorail track, and that provide lateral support for the monorail car. A common problem with many such monorail bogies is that as the monorail bogies travel over a curved section of track, there is a significant increase in the load on certain guide wheels of the monorail bogie. In most cases the monorail bogie will have four guide wheels that travel along the side surfaces of the monorail track; namely an outboard inner guide wheel, an outboard outer guide wheel, an inboard inner guide wheel and an inboard outer guide wheel. As used herein, the term "inboard" refers to the side of the monorail bogie 14 that is closer to the centre of the monorail car body 12 and the term "outboard" refers to the side of the monorail bogie 14 that is closer to the end of the monorail car body 12. In addition, the term "inner guide wheel" refers to the wheels on the interior side of a curve and the term "outer guide wheel" refers to the wheels on the outer side of a curve.

When a monorail bogie travels over a curved section of track, there is an increase in the load on the outboard inner guide wheel. This increase in load is generally caused as a result of a high rotational stiffness between the monorail bogie and the monorail car, which prevents the monorail bogie from being properly aligned with the monorail track during travel through a curved section of track. This misalignment results in the outboard inner guide wheels (and in some cases the inboard outer guide wheel) to be compressed against the track. This compression creates relatively high load forces on the outboard inner guide wheel (and often the inboard outer guide wheels), which can undesirably cause premature wear of the guide wheels.

In light of the above, it can be seen that there is a need in the industry for an improved monorail bogie that improves on the overall functionality of existing monorail bogies and that better distributes and reduces the load experienced by the guide wheels especially when the monorail car travels over a curved section of monorail track.

SUMMARY OF THE INVENTION

In accordance with a first broad aspect, the present invention provides a traction control assembly for connection between a monorail bogie frame and a monorail car. The traction control assembly comprising a first traction link pivotally connected to a first bell crank mechanism and a second traction link pivotally connected to a second bell crank mechanism. The first traction link and the second traction link are capable of absorbing traction forces applied to the monorail bogie. The traction control assembly further comprises a cross link interconnecting the first bell crank mechanism and the second bell crank mechanism and a steering assist device interconnecting the first bell crank mechanism and the second bell crank mechanism. The steering assist device causes the traction control assembly to insert shear forces on the monorail bogie during travel of the monorail bogie over a curved section of monorail track for facilitating rotational motion between the monorail bogie and the monorail car.

In accordance with a second broad aspect, the present invention provides a monorail bogie assembly for supporting a monorail car over a monorail track. The monorail bogie assembly comprises a monorail bogie body comprising a frame, at least one load bearing wheel, a first guide wheel on a first side of the frame, a second guide wheel on a second side of the frame and a first stabilising wheel on the first side of the frame. The monorail bogie assembly further comprises a first traction link pivotally connected to a first bell crank mechanism and a second traction link pivotally connected to a second bell crank mechanism. The first traction link and the second traction link are capable of absorbing traction forces applied to the monorail bogie. The monorail bogie assembly further comprises a cross link interconnecting the first bell crank mechanism and the second bell crank mechanism and a steering assist device interconnecting the first bell crank mechanism and the second bell crank mechanism. The steering assist device causing the traction control assembly to insert shear forces on the monorail bogie during travel of the monorail bogie over a curved section of monorail track for facilitating rotational motion between the monorail bogie and the monorail car.

In accordance with a third broad aspect, the present invention provides a method of operation of a steering assist device, the steering assist device being part of a monorail bogie supporting a monorail car. The steering assist device is pivotally connected to a first bell crank mechanism and a second bell crank mechanism that connect the monorail bogie to the monorail car via first and second traction links. The method comprises during travel of the monorail bogie over a curved section of monorail track, exerting a moment on the first and second bell crank mechanism for causing the first and second traction links to insert shear forces for countering shear forces created by a suspension system and during travel of the monorail bogie over a straight section of monorail track, remaining in line with the first and second bell crank mechanisms so that no moment is exerted on the first and second bell crank mechanisms.

These and other aspects and features of the present invention will now become apparent to those of ordinary skill in the art upon review of the following description of specific embodiments of the invention and the accompanying drawings. It will also be apparent that this invention could be applied to other technologies having single axle bogies including but not limited to rail vehicles, trolleys, wheeled carts without guide wheels, automotive applications, etc.

Other aspects and features of the present invention will become apparent to those ordinarily skilled in the art upon review of the following description of specific embodiments of the invention in conjunction with the accompanying figures.

DETAILED DESCRIPTION

Figure 1:
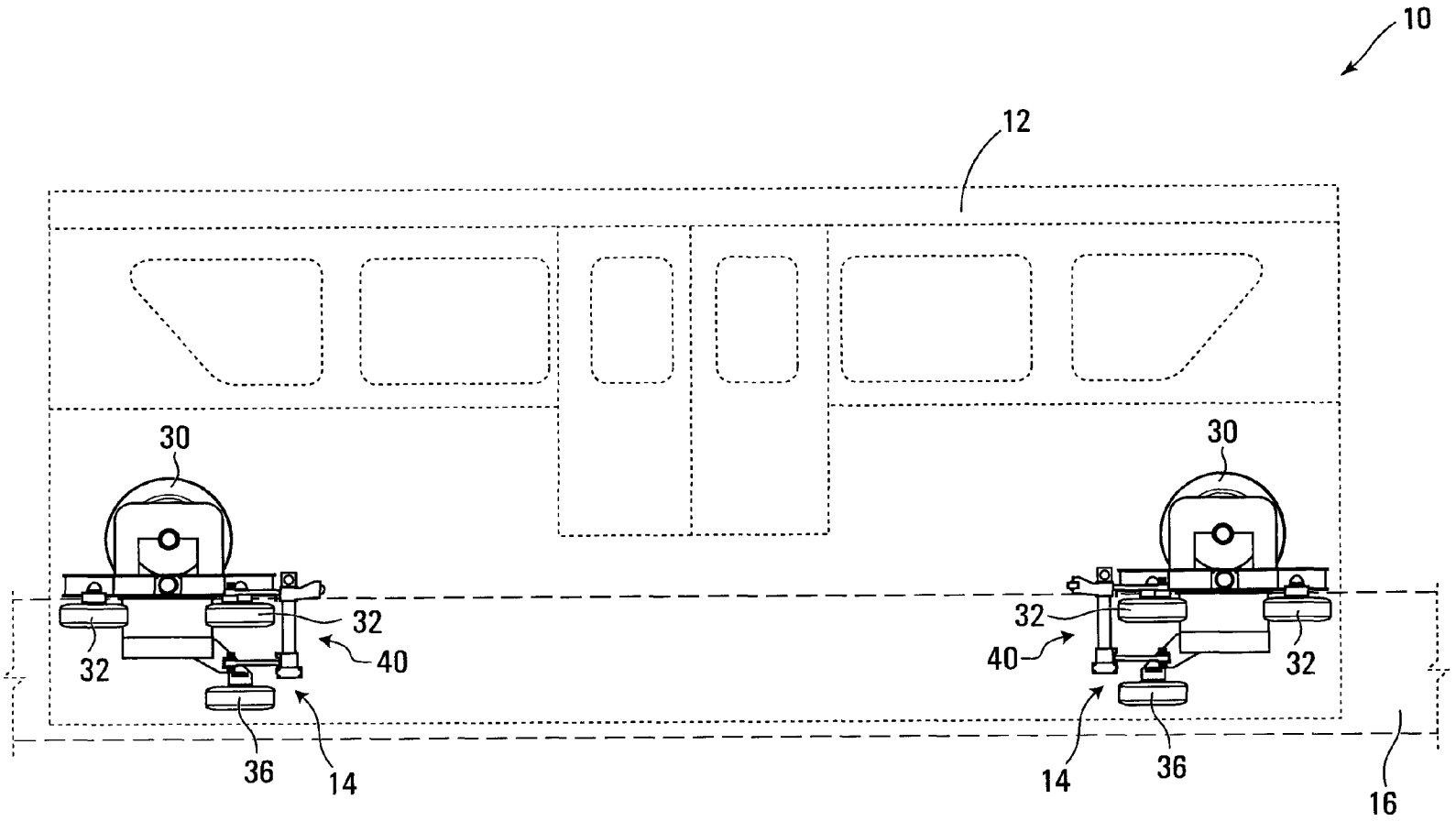
FIG. 1 shows a side view of two single-axle bogies in accordance with a first non-limiting example of implementation of the present invention for supporting a monorail car which is shown in dotted lines.

Referring to the drawings and particularly to FIG. 1, a non-limiting example of a monorail car assembly 10 for traveling over a monorail track 16 is illustrated. The monorail car assembly 10 comprises a monorail car 12 and two single-axle bogies 14 that are operative for supporting the monorail car 12 over the monorail track 16. As will be described in more detail below, the single-axle bogies 14 in accordance with the present invention each include a traction control assembly 40 that comprises a steering assist device 42. The traction control assembly 40 provides a structure that is able to help manage longitudinal traction forces, and the steering assist device 42 helps to manage load forces exerted on the guide wheels 32 by inserting shear forces on the monorail bogie 14 for countering shear forces exerted on the bogie by a secondary suspension system. As will be explained in more detail below, the steering assist device 42 thus helps to reduce, and more evenly distribute, the load forces applied to the guide wheels 32 during travel of the monorail bogie 14 over a curved section of the monorail track 16.

The traction control assembly 40 that will be described and illustrated herein further comprises a pitching control mechanism for helping to reduce the pitching movement of each of the single-axle bogies 14 in relation to the monorail car 12. The pitching control mechanism is an optional component, and is described in more detail in co-pending PCT patent application PCT/CA2009/001487 filed on Oct. 19, 2009.

Although the monorail car 12 shown in FIG. 1 is a passenger car, it should be appreciated that in an alternative embodiment, the monorail car 12 could also be a cargo car or any other type of monorail car. The single-axle bogies 14 described herein can be used with any such rail car, such as a passenger car or cargo car, among other possibilities.

Figure 3:
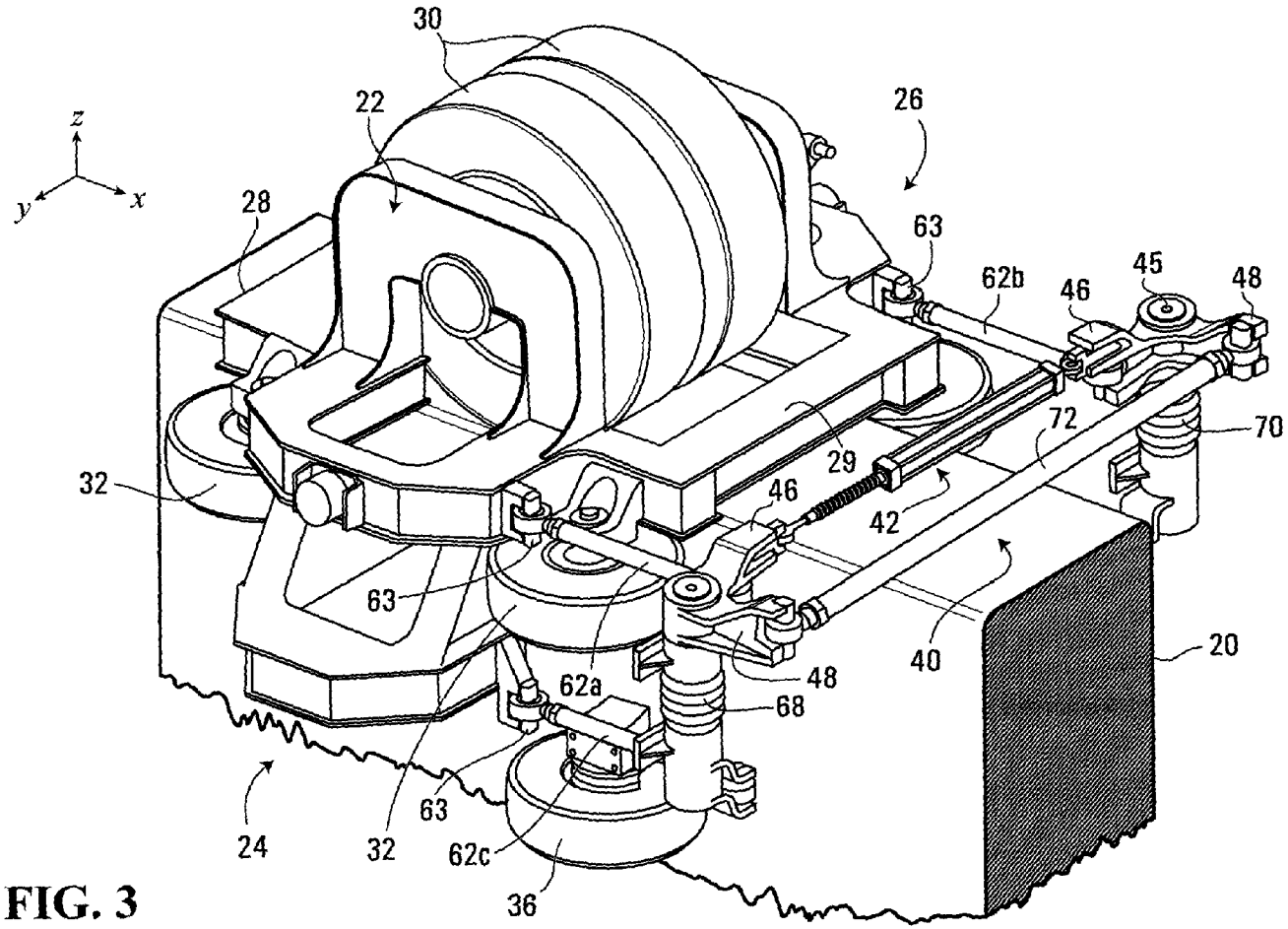
FIG. 3 shows a rear perspective view of the traction control assembly of FIG. 2 attached to a single axle bogie.

As best shown in FIG. 3, the monorail track 16 includes a substantially horizontal running surface 18 and two side surfaces 20. The monorail track 16 can be positioned along a ground-based guideway, or can be supported on elevated structures above the ground, such as in the case of an elevated transit system.

Traction Control Assembly 40

Figure 2:
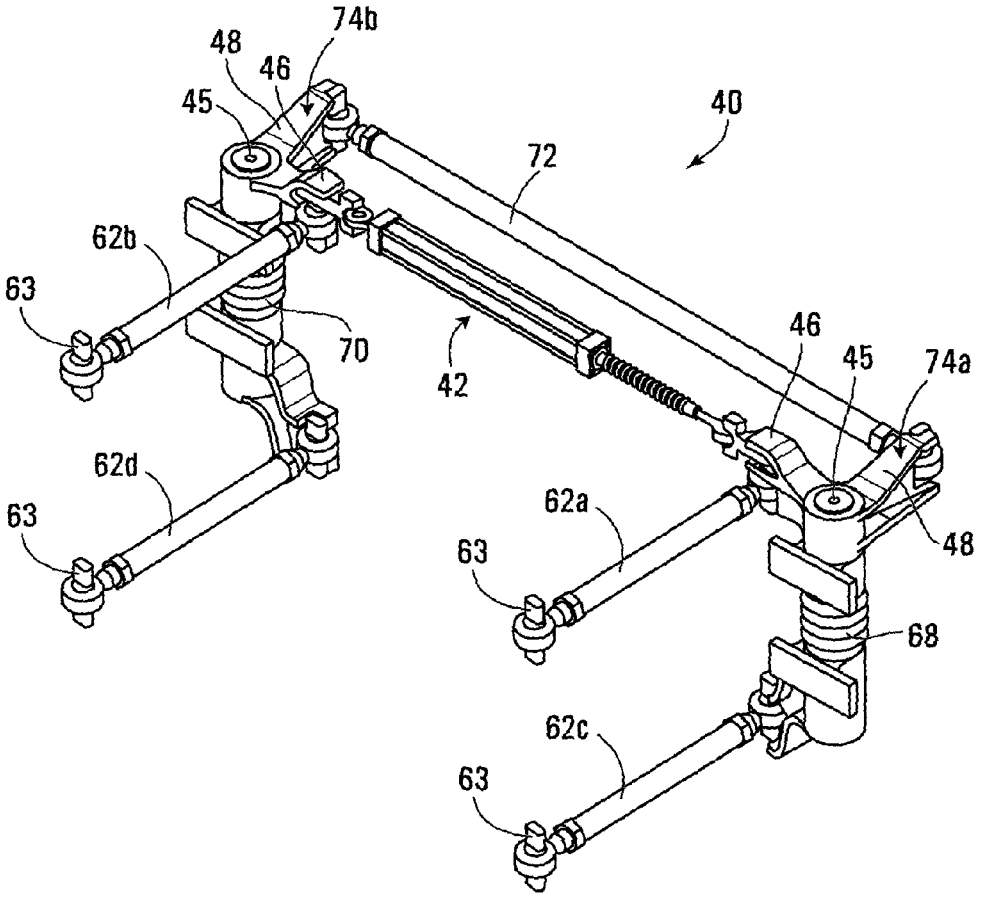
FIG. 2 shows a front perspective view of a traction control assembly having a steering assist device in according with a non-limiting example of implementation of the present invention.

Illustrated in FIG. 2 is a perspective view of the traction control assembly 40 in accordance with a non-limiting example of the present invention. For ease of understanding, the traction control assembly 40 shown in FIG. 2 is shown unattached to a bogie such that each of the components of the traction control assembly 40 can be seen clearly.

As will be described in more detail below, the traction control assembly 40 of the present invention comprises first and second traction links 62*a*, 62*b* (upper traction links), a cross link 72 and a steering assist device 42, which are connected together via first and second bell crank mechanisms 74*a* and 74*b*. In the embodiment shown, the traction control assembly 40 further comprises optional third and fourth traction links 62*c*, 62*d* (lower traction links) and pitching control linking members 68 and 70. These optional components will be described in more detail below.

Figure 4:
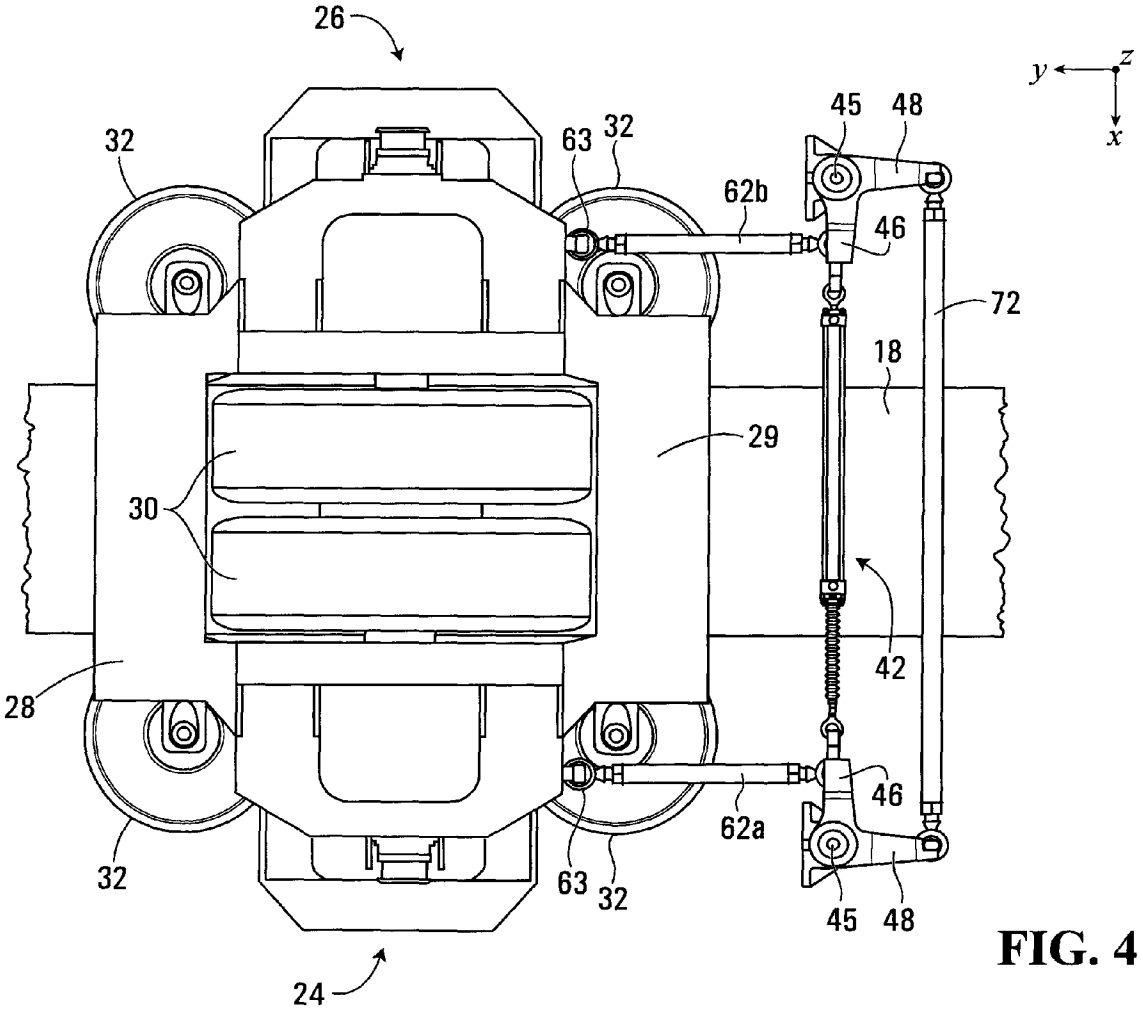
FIG. 4 shows a top view of the traction control assembly of FIG. 3 attached to the single axle bogie.

The bell crank mechanisms 74*a* and 74*b* each comprise a first arm 46, a second arm 48, and a central pivot point 45 at the juncture of the first arm 46 and second arm 48. As best shown in FIG. 4, the first arm 46 and the second arm 48 of each of the bell crank mechanisms 74*a*, 74*b* form an approximate "L" shaped member. In the present embodiment, the cross link 72 is pivotally attached to the ends of the second arms 48, and the steering assist device 42 is pivotally attached to the ends of the first arms 46. Furthermore, the traction links 62*a*, 62*b* are pivotally attached to the first arms 46 at a position between the central pivot point 45 and the steering assist device 42. These two arms 46 and 48 of the bell crank mechanisms 74*a*, 74*b* always remain in the same configuration with respect to each other.

The traction links 62*a*, 62*b* in combination with bell crank mechanisms 74*a* and 74*b* and cross-link 72 provide a traction assembly to transmit traction and braking forces from the bogie 14 to the car body 12. The cross link 72 enables the restraint of traction movement, while permitting free yaw rotation of the single-axle bogie 14 in relation to the monorail car 12. Accordingly, the traction control assembly 40 provides noise and vibration isolation for the passenger compartment while maintaining firm guide tire alignment and adjustment. The traction control assembly 40 permits the stiffness and damping characteristics for each of the traction restraints to be selected and defined independently, such that a person of skill in the art is able to achieve the desired operating parameters.

The central pivot point 45 of the bell crank mechanisms 74*a*, 74*b* are adapted for pivotally connecting the bell crank mechanisms 74*a* and 74*b* to one of the monorail car 12 or the monorail bogie 14. In the embodiment shown in FIGS. 3-6, the central pivot points 45 of the bell crank mechanisms 74*a* and 74*b* are adapted for being connected to the monorail car body (not shown) via intermediate pillow blocks, for example. The pillow blocks can be attached to the frame of the monorail car 12 in a variety of different manners. For example, the pillow blocks can be attached via a resilient bushing at the top and at the bottom of the pitching control linking members 68 and 70. These pillow blocks permit the bell crank mechanisms 74*a*, 74*b* to pivot freely relative to the monorail car 12 while transmitting longitudinal traction forces between the monorail bogie 14 and the monorail car 12. The resulting lateral forces caused by traction forces from cross link 72 are also transferred to the monorail car 12.

In the embodiment where the bell crank mechanisms 74*a*, 74*b* are connected to the frame of the monorail car 12, the traction links 62*a*, 62*b* are pivotally connected to the monorail bogie 14, as shown in FIGS. 3-6. Positioned at the ends of the traction links 62*a*-62*b* are pivotal ends 63 for connecting the traction control assembly 40 to the monorail bogie 14. The traction links 62*a*, 62*b* can be attached to the body portion 22 of the bogie 14 via any suitable attachment mechanism that permits the traction links 62*a*, 62*b* to pivot in relation to the body portion 22 of the bogie 14. For example, the traction link 62*a* and the traction link 62*b* may be attached to the monorail bogie 14 via a spherical ball joint (either a resilient or sliding ball joint depending on the desired characteristics of a particular application, to establish a desired combination of pitch stiffness, damping and longitudinal traction stiffness and damping).

Therefore, the traction control assembly 40 is adapted for being interconnected between the monorail car 12 and the monorail bogie 14 so as to be able to provide traction restraint and a reduction in the load felt by the guide wheels 32 during travel over a curved section of track.

In an alternate embodiment that will not be described herein, traction control assembly 40 may be connected between the monorail bogie 14 and the monorail car 12 in the opposite manner, with the bell crank mechanisms 74*a*, 74*b* pivotally attached to the monorail bogie 14, and the ends of the traction links 62*a*, 62*b* each connected to the frame of the monorail car 12.

Pitching Control Mechanism 50

Although optional to the present invention, the traction control assembly 40 shown in the Figures further comprises a pitching control mechanism that comprises two pitching control linking members 68 and 70, best shown in FIGS. 2 and 3. The pitching control linking members 68 and 70 are pivotally connected to pillow blocks that connect the traction control assembly 40 to the monorail car. The pitching control linking members 68 and 70 rotate along their longitudinal axis together with the rotation of the first and second bell crank mechanisms 74*a*, 74*b* respectively. The pitching control linking members 68 and 70 are substantially perpendicular to the first and second traction links 62*a*, 62*b* and are positioned parallel to a side surface 20 of the monorail track when in use. At their other end, the pitching control linking members 68 and 70 are pivotally connected to third and fourth traction links 62*c*, 62*d*, which in turn are connected to the monorail bogie 14.

The pitching control linking members 68, 70 can each be considered as torsion bars that in combination with the first and second traction links 62*a*, 62*b* (the upper traction links) and the third and fourth traction links 62*c*, 62*d* (the lower traction links), control pitching movement of the monorail bogie 14. The pitching control linking members 68, 70 are positioned such that their longitudinal axes are positioned substantially perpendicular to the running surface 18 of the monorail track 16, when in use. As such, the pitching control linking members 68, 70 have a substantially vertical orientation in relation to the running surface 18 of the monorail track 16. The pitching control linking members 68 and 70, together with the lower traction links 62*c*, 62*d*, provide pitch stabilization forces.

More specifically, the traction links 62*c*, 62*d* are pitch stabilizing rods for providing pitch stabilization in combination with the pitching control linking members 68, 70, so as to prevent the monorail bogie 14 from pitching in relation to the monorail car 12. The combination of the pitching control linking members 68, 70 and the lower traction links 62*c*, 62*d* enable the bogie pitch to be adjusted and stabilized. It is the adjustment of the lower pitch traction links 62*c*, 62*d* that provides pitch alignment of the bogie frame and guide tires.

The pitching control function could be achieved with only one of the pitching control linking members 68 or 70 in combination with its respective lower traction link 62*c*, 62*d*. It will be appreciated by those skilled in the art that by including both pitching control linking members 68 and 70, such that there is a redundant pitching control linking member, it would be possible to retain traction and pitch control even in the event of a single failure of any one of the traction links 62*a*, 62*b*, 62*c*, or 62*d*.

Further discussion of the pitching control mechanism 50 is provided in co-pending PCT patent application PCT/CA2009/001487 filed on Oct. 19, 2009, and as such will not be described in further detail herein. It will be understood that the functionality of the traction control assembly 40 that will be described in further detail below, can be provided without the need for the pitching control mechanism described above.

Description of the Monorail Bogie 14

The following section will describe a non-limiting example of a single axle monorail bogie 14 to which the traction control assembly 40 of the present invention can be connected. The shapes and proportions of the various components that form the monorail bogie 14 shown in the drawings are purely used for illustration purposes and should be considered non-limiting. Deviation in the form of making the components wider, longer or thinner can be made by a person skilled in the art to make the bogie perform in the environment in which the system is designed to operate. In certain places, due to the difference in orientation, certain reference numbers may not be found in certain ones of the figures.

With reference to FIG. 3, the monorail bogie 14 includes a body portion 22 that has a first side portion 24 and a second side portion 26 that are joined together by a front joining portion 28 (the outboard side) and a rear joining portion 29 (the inboard side). The body portion 22 of the single-axle bogie 14 can be made of steel or a steel alloy, among other possibilities. It should be appreciated that the single-axle bogie 14 can be made of a variety of different materials, so long as the material provides the desired strength and rigidity characteristics for the intended application.

When the single-axle bogie 14 is positioned on the monorail track 16, the front joining portion 28 and the rear joining portion 29 extend over the running surface 18 of the monorail track 16. In addition, the first side portion 24 and the second side portion 26 are positioned such that they are adjacent respective ones of the two side surfaces 20 of the monorail track 16. In the embodiment shown, the front joining portion 28 and the rear-joining portion 29 are in the form of rectangular shaped beams. It should, however, be appreciated that the front joining portion 28 and the rear joining portion 29 could be of any shape, size and configuration that is suitable for joining the first side portion 24 and the second side portion 26 of the single-axle bogie 14 together. In addition, the front joining portion 28 and the rear-joining portion 29 are not necessarily required to be facing frontward or rearward when the single-axle bogie 14 is attached to the monorail car 12. Instead, the front joining portion 28 and the rear-joining portion 29 can be positioned in either direction of travel.

The single axle monorail bogie 14 shown in FIGS. 3-6 is operative for supporting one or more load-bearing wheels 30, and four guide wheels 32 that comprises an outboard pair of guide wheels and an inboard pair of guide wheels. As used herein, the term "inboard" refers to the side of the monorail bogie 14 that is closer to the centre of the monorail car body 12 and the term "outboard" refers to the side of the monorail bogie 14 that is closer to the end of the monorail car body 12. In addition, the body portion 22 is operative for supporting two stabilizing wheels 36. In the embodiment shown, the stabilizing wheels 36 are positioned beneath, and coaxial with, the "inboard" pair of guide wheels 32 of the single axle bogie 14. It should, however, be appreciated that the stabilizing wheels 36 could also be positioned beneath the "outboard" guide wheels 32, or at any position in between the inboard guide wheels and the outboard guide wheels, without departing from the spirit of the invention. In an alternative embodiment that is not shown, additional stabilizing wheels may be positioned below each of the guide wheels 32, such that the monorail bogie 14 includes four stabilizing wheels 36.

The load-bearing wheels 30, guide wheels 32 and stabilizing wheels 36 are generally made of rubber; however, they can also be pneumatic tires, semi-pneumatic tires, solid rubber tires, plastic tires, metal wheels or any other type of tire or wheel known in the art.

As shown in FIGS. 3-6, the traction links 62*a*, 62*b* of the traction control assembly 40 are connected to the monorail bogie 14 slightly above the pair of inboard guide wheels 32 and the links 62*c*, 62*d* are connected slightly above the stabilizing wheels 36, respectively. It must be noted that the traction links do not always have to be above the guide wheels and the stabilizing wheels. As long as the upper traction links 62*a*, 62*b* are transposed vertically above the lower traction links 62*c*, 62*d* to accommodate the pitch function (in the case where the pitch control mechanism is included), any relative positioning of the traction links with the guide wheels and/or the stabilising wheels is allowed and should be considered as being part of the disclosed invention.

The traction links 62*a*, 62*b* are attached to the monorail bogie 14 such that their longitudinal axes are positioned substantially parallel to the running surface 18 of the monorail track 16. In addition, the traction links 62*a*, 62*b* are positioned such that they are offset to either side of the running surface 18 of the monorail track 16 and are positioned in substantially the same plane as the running surface 18 of the monorail track 16. By placing the upper traction links 62*a*, 62*b* co-planar with the running surface 18, the torque pitching of the bogie frame is minimized. More specifically, if mounted at the level of the running surface 18, the two traction links 62*a*, 62*b* take the majority of the traction forces, such that the two lower traction links 62*c*, 62*d*, (in the case where they are provided) simply provide pitch stabilization in combination with the first and second pitching control linking members 68 and 70. In addition, by placing the upper traction links 62*a*, 62*b* on the sides of the running surface 18, they do not extend into the passenger compartment of the monorail vehicle.

As mentioned above, the traction links 62*a*, 62*b* are suitable for absorbing the traction forces created by the monorail car assembly 10. The traction forces are also absorbed by the cross link 72, which helps to transfer these forces to the traction links 62*a*, 62*b* via the bell crank mechanisms 74*a*, 74*b*.

The bell crank mechanisms 74*a*, 74*b* help the traction links 62*a*, 62*b* absorb the traction loads, and take the traction loads outside of the monorail track envelope. More specifically, by taking the fraction forces to each side of the monorail track 16, the traction links 62*a*, 62*b* can be positioned at the height of the monorail track running surface 18. This reduces the pitching moments caused by traction forces such that the majority of the traction forces are absorbed by the upper traction links 62*a*, 62*b*. As such, the traction links 62*c*, 62*d* (when included as part of the traction control assembly 40) do not need to absorb any traction forces and instead are used to stabilize any remaining pitching moment forces.

In the case where the upper traction links 62*a*, 62*b* are not positioned in substantially the same plane as the running surface 18, then some of the traction forces are transferred to the lower traction links 62*c*, 62*d*. More specifically, when the traction links 62*a*, 62*b* are not aligned with the running surface 18 of the monorail track 16, there is progressive interaction between the traction forces and the pitching alignment.

In the embodiment shown, the traction links 62*a*, 62*b* are solid, bone-shaped rods that have a suitable thickness and material strength to be able to handle the traction forces generated. Each of the traction links 62*a*, 62*b* can be of any shape, size, and configuration, so long as they are able to meet their intended function. In addition, it is possible for the upper traction links 62*a*, 62*b* to be different from the lower traction links 62*c*, 62*d*, such that the lower traction links 62*c*, 62*d* can be of lighter duty material than the traction links 62*a* and 62*b*.

The design, and material characteristics of each of the traction links 62*a*, 62*b*, can be selected based on the desired characteristics of the traction control assembly 40. For example, the selection of the stiffness (which could be based on material characteristics, or design) of the traction links 62*a*-62*b*, the bell crank mechanisms 74*a*, 74*b* and the cross link 72 provides the ability to independently select the bogie traction (longitudinal) stiffness and pitch stiffness.

The materials and design of each individual one of the traction links 62*a*-62*b*, the cross link 72 and the bell crank mechanisms 74*a*, 74*b* can be chosen separately so as to customise the handling of the traction control assembly 40. More specifically, the stiffness of the traction links 62*a*, 62*b;* the bell crank mechanisms 74*a*, 74*b* and the stiffness of the cross link 72, can be selected independently for customizing the functionality of the traction control assembly 40. The cross bar 72 can be a stiff crossbar 72 with resilient bell crank mechanisms 74*a*, 74*b* at each connecting end in order to reduce noise and vibration and to prevent dynamic interactions between the monorail bogie 14 and the frame of the monorail car 12.

By customizing the pitch stiffness and longitudinal stiffness of the bogie 14 relative to the monorail car body 12, the resonance and vibration transmission to the monorail car body 12 as well as undesirable noise, and/or undesirable guide tire wear can be minimized.

As shown in FIG. 1, the traction control assembly 40 is generally positioned on the inboard side of the monorail bogie 14. However, the traction control assembly 40 could equally be mounted to the "outboard" side of the monorail bogies 14, without detracting from its functionality.

Steering Assist Device 42

The steering assist device 42, which is shown in many of the Figures, will now be described in more detail with reference to FIGS. 5 through 7B. As mentioned above, the steering assist device 42 is operative for facilitating the rotational motion between the monorail bogie 14 and the monorail car 12 such that the monorail bogie 14 is better able to maintain its alignment with the monorail track 16 when traveling around curved sections of track. By maintaining good alignment with the monorail track 16, increased loads on individual ones of the guide wheels 32 is avoided.

Although not shown in any of the Figures, included between the monorail bogie 14 and the monorail car 12 is a secondary suspension arrangement (which could be a set of airbags, among other possibilities). While this secondary suspension arrangement provides valuable suspension for the monorail car 12, it also applies shear loading to the monorail bogie 14 when the monorail bogie 14 is traveling around a curved section of the monorail track 16, which creates increased rotational stiffness between the monorail bogie 14 and the monorail car 12. This increased rotational stiffness can prevent the monorail bogie 14 from aligning itself completely with the monorail track 16. Therefore, in order to reduce this rotational stiffness, the steering assist device 42 of the present invention is operative for applying shear forces to the monorail bogie that counter the shear forces applied by the secondary suspension arrangement. This helps to reduce the rotational stiffness and facilitate rotational motion between the bogie 14 and the monorail car 12, thereby enabling the monorail bogie 14 to remain in better alignment with the monorail track 16.

In accordance with a non-limiting embodiment, the steering assist device 42 according to the present invention is a passive device that does not require input energy or commands in order to function. The steering assist device 42 is not actively driven and instead functions as a result of the different forces applied to the bell crank mechanisms 74*a*, 74*b* to which it is attached. In an alternative non-limiting embodiment, the steering assist device 42 can be an active component.

The following non-limiting example of a practical situation helps to illustrate this dynamic. Let us assume that the monorail bogie 14 is travelling around a curved section of monorail track 16 that has a 46 m curve radius. In order for the monorail bogie 14 to properly align itself with the monorail track 16, there would need to be a bogie-to-car body rotation of about 100 mrads. However, when no steering assist device 42 is present, the shear forces applied to the monorail bogie 14 by the secondary suspension arrangement increase the rotational stiffness between the monorail bogie 14 and the monorail car 12, such that the bogie-to-car body rotation is only about 80 mrads. This results in about 20 mrads of misalignment between the monorail bogie 14 and the monorail track 16, which causes the outboard inner guide wheel 32 of the monorail bogie 14 to be compressed against the sides of the monorail track 16, thereby causing undesirable additional loading to be applied to the outboard inner guide wheels 32. More specifically, this rotational stiffness means that additional force is be applied to the diagonally opposite wheels of the bogie 14, namely to outboard inner guide wheel 32 and to inboard outer guide wheel 32. Likewise this rotational stiffness causes loads to be removed from the other two guide wheels. When the lateral force reacting on the normal acceleration in the curve is superimposed, the addition of efforts results in one load wheel 32 per bogie being particularly overloaded, namely the outboard inner guide wheel 32.

Therefore, in order to help reduce this additional loading on some of the outboard guide wheels, the traction control assembly 40 of the present invention comprises the steering assist device 42. The steering assist device 42 applies shear forces to the monorail bogie 14 that counter the shear forces applied by the secondary suspension arrangement, thereby reducing the rotational stiffness between the monorail bogie 14 and the monorail car 12 and facilitating the rotational motion between these two components. This enables the monorail bogie 14 to remain in better alignment with the monorail track 16 when travelling around curved sections of monorail track 16, which in turn, reduces the load on some of the outboard guide wheels 32.

Figure 5:
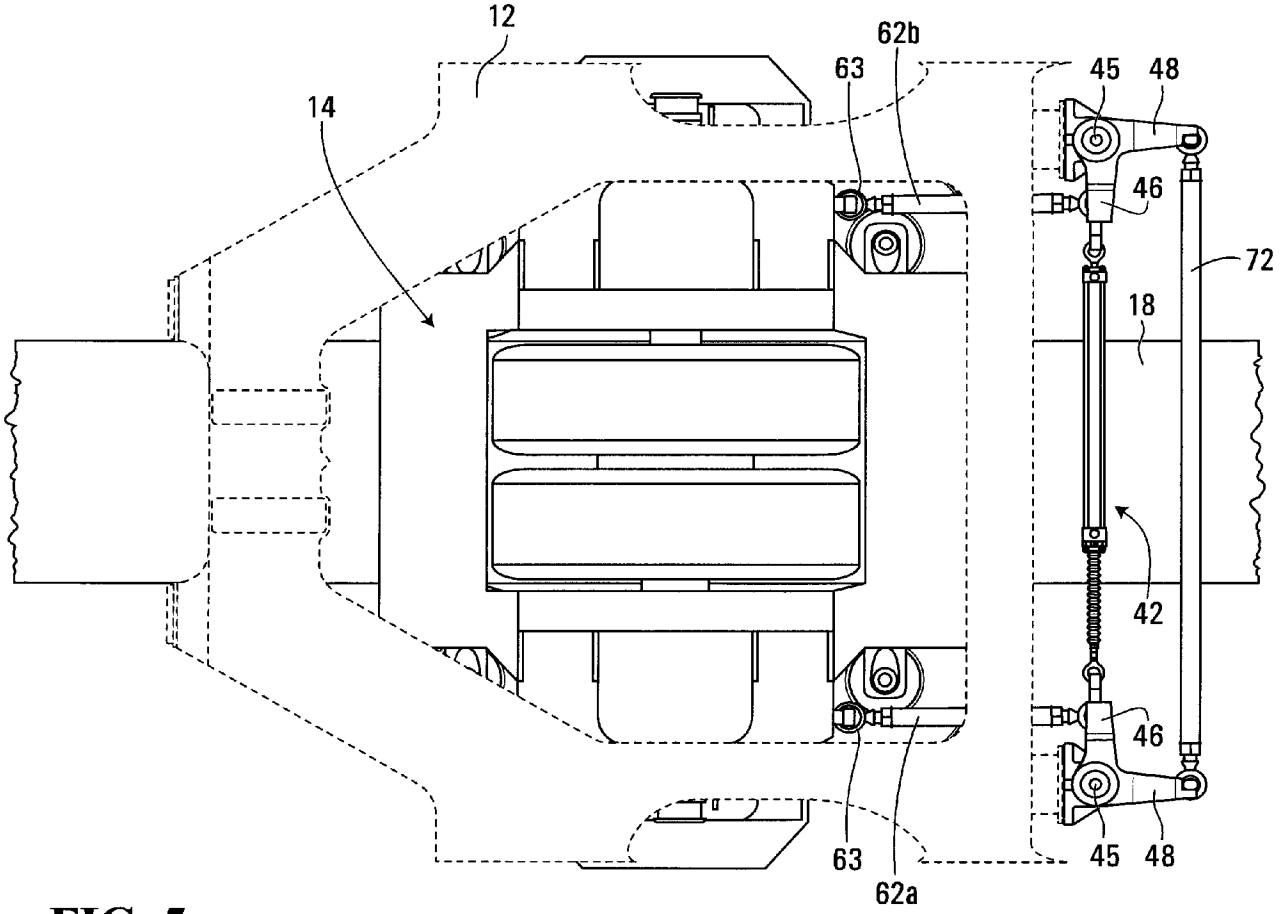
FIG. 5 shows a top view of the traction control assembly of FIG. 3 attached to the single axle bogie with a portion of the monorail car body shown in dotted lines, wherein the monorail bogie is traveling over a straight section of monorail track.

The manner in which the steering assist device 42 applies these shear forces to the monorail bogie 14 will now be explained in more detail. Shown in FIG. 5 is the traction control assembly 40 connected between the monorail bogie 14 and the monorail car 12, with the monorail car 12 shown in dotted lines. The steering assist device 42 is shown interconnecting the two arms 46 of the bell crank mechanisms 74*a*, 74*b*. In the case where the monorail bogie 14 is travelling over a straight section of monorail track 16, as shown in FIG. 5, the longitudinal axis of the steering assist device 42 is substantially parallel to the cross link 72.

When positioned between the two arms 46, the steering assist device 42 is under compression, such that it exerts outward forces on the bell crank mechanisms 74*a*, 74*b*. These outward forces are in alignment with a longitudinal axis of the steering assist device 42. In the non-limiting example shown in FIG. 5, the steering assist device 42 is in the form of a hydraulic cylinder. However, the steering assist device 42 could be any other device that is able to fit between the two bell crank mechanisms 74*a*, 74*b* under compression. For example, the steering assist device 42 could also be a mechanical helicoil spring cylinder or a pneumatic cylinder, among other possibilities.

In accordance with a non-limiting example, the hydraulic cylinder of the steering assist device 42 can comprise a cylinder piston, rod and seals that are standard components in the industry. At least the cylinder portion may be made of a steel material having a steel Grade of ST52.3, and the hydraulic fluid may be any hydraulic oil conforming to MIL-PRF-83282. In addition, the hydraulic cylinder can be designed to operate within a temperature range of −30 to 75° C. and a pressure range of up to 2500 PSI. In general, hydraulic cylinders of the steering assist device 42 according to the present invention comprise gas valves and bleed adaptors. The connector ends that connect the hydraulic cylinder to the bell crank mechanisms can be any type of connector end suitable for pivotally connecting the hydraulic cylinder to the bell crank mechanisms. It should be understood that the above values and examples for the hydraulic cylinder of the steering assist device 42 are given strictly for the purposes of illustration, and should not be used to limit the scope of the present invention. Other embodiments and specifications for the steering assist device 42 are possible depending on its given application, and a person of skill in the art would understand how to select an appropriate steering assist device 42 in order to achieve the functionality described herein.

In accordance with a non-limiting practical example, the steering assist device 42 may have a free length of approximately 1100 mm prior to compression. Under compression of 40 N/mm, the free length is compressed by approximately 400 mm in order to be connected between the two arms 46 of the bell crank mechanism 74*a*, 74*b*. As such, it has a compressed length of approximately 700 mm when positioned between the arms 48 of the two bell crank mechanisms 74*a*, 74*b*. At this compression, the steering assist device 42 provides an outward load of 16 KN. It should be understood that these values are given strictly for the purposes of illustration, and that a steering assist device 42 in accordance with the present invention is not limited to these values.

Because the steering assist device 42 is under compression when it is installed between the two bell crank mechanisms 74*a*, 74*b*, it exerts an outward load parallel to, and in alignment with, its longitudinal axis. When travelling over a straight section of monorail track 16, the longitudinal axis of the steering assist device 42 is substantially in alignment with the central pivot point 45 of the two bell crank mechanisms 74*a*, 74*b*. As a result of this alignment, the loads being applied to the bell crank mechanisms 74*a*, 74*b* by the steering assist device 42 do not create any moment forces on the bell crank mechanisms 74*a*, 74*b*. As such, no shear forces are applied to the monorail bogie 14 as a result of the steering assist device 42 when the monorail bogie 14 is travelling over a straight section of monorail track 16.

Figure 6:
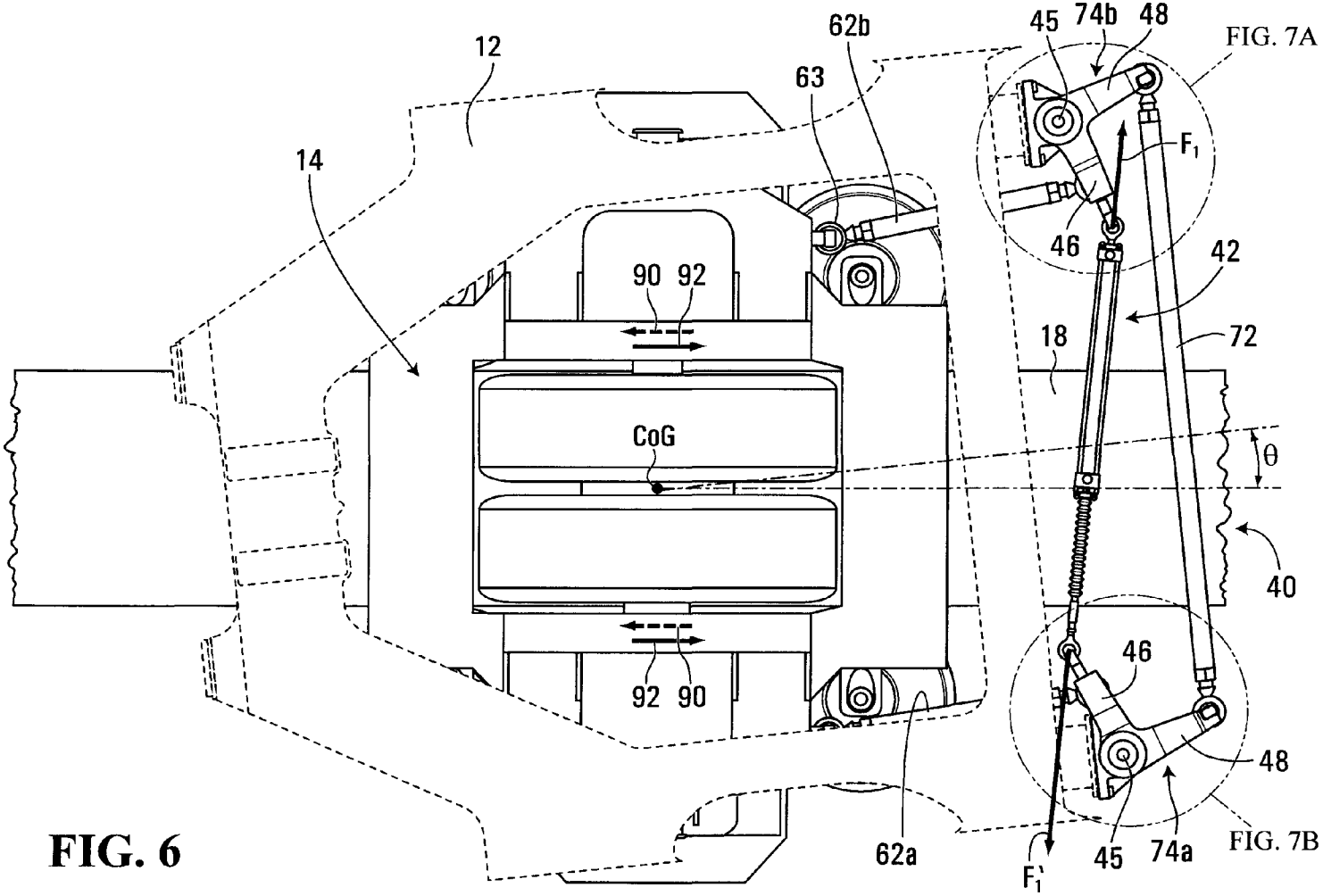
FIG. 6 shows a top view of the traction control assembly of FIG. 3 attached to the single axle bogie with a portion of the monorail car body shown in dotted lines, wherein the monorail bogie is traveling over a curved section of monorail track.

Now let us consider the forces acting on the monorail bogie 14 when it travels over a curved section of monorail track 16, as shown in FIG. 6. Once again, the traction control assembly 40 is shown together with the steering assist device 42 connected between the monorail bogie 14 and the monorail car 12, with the monorail car 12 shown in dotted lines. In this non-limiting example, the monorail car 12 and monorail bogie 14 are travelling over a section of monorail track 16 that is curved to the left with a θ radius of curvature. For the sake of example, let us assume that the bogie 14 that is shown is a trailing bogie that is travelling in a direction towards the right of the page. As such, the curved section of monorail track 16 is a left-hand curve.

As mentioned above, when travelling over a curved section of monorail track 16, it is desirable for the monorail car 12 and the monorail bogie 14 to have a relatively low rotational stiffness between them, such that the monorail bogie 14 can pivot easily in relation to the monorail car 12. In this manner, the monorail car 12 can be at an angle in relation to the monorail bogie 14 (such that it can span between two monorail bogies 14 that are positioned at different points on the curved track), while the monorail bogies 14 that support the monorail car 12 can remain substantially in alignment with monorail track 16. This is shown in FIG. 6, wherein the monorail car 12 is pivoted in relation to the monorail bogie 14 at an angle of θ.

When the monorail bogie 14 travels around a section of monorail track that is curved to the left, as shown in FIG. 6, the secondary suspension arrangement applies a shear force, that is represented by arrow 90, to the monorail bogie 14, which tends to rotate the monorail bogie in a counter-clockwise direction around its center of gravity (CoG). This shear force 90 increases the rotational stiffness between the monorail car 12 and the monorail bogie 14, which will cause the monorail bogie 14 to follow the rotational movement of the monorail car 12. This hinders the monorail bogie's ability to remain aligned with the monorail track.

As such, the steering assist device 42 in accordance with the present invention causes a shear force, represented by arrow 92, to be applied to the monorail bogie 14 to counter the shear force 90 exerted by the secondary suspension arrangement. This countering shear force 92 reduces the rotational stiffness between the monorail car 12 and the monorail bogie 14, and thereby facilitates the rotational motion between the monorail car 12 and the monorail bogie 14 such that the monorail bogie 14 can remain in better alignment with the monorail track 16.

The guide wheels 32 position the monorail bogie 14 in the curve. If the rotation between the monorail bogie 14 and the monorail car 12 was negligible, then the outboard inner guide wheel would not be overloaded. However, the secondary suspension causes an increase in the rotational stiffness of the monorail bogie 14 which reduces the rotation of the monorail bogie 14 in relation to the monorail car 12 when in a curve. The monorail bogie 14 thus has to fight against the rotational moment generated by the guide wheels 32. The steering assist device 42 counteracts the shear moment from the secondary suspension, thereby improving the monorail bogie's ability to rotate in relation to the monorail car 12.

The shear force 92 that is applied to the monorail bogie 14 is applied as a result of the moment forces applied to the bell crank mechanisms 74*a*, 74*b* by the steering assist device 42. More specifically, as the monorail car 12 pivots in relation to the monorail bogie 14, the bell crank mechanisms 74*a*, 74*b* pivot about their central pivot points 45. In the case where the monorail car 12 pivots counter-clockwise with respect to the monorail bogie 14, as shown in FIG. 6, this causes bell crank mechanisms 74*a*, 74*b* to pivot in a counter-clockwise direction, as well. As a result of this counter-clockwise rotation of the bell crank mechanisms 74*a*, 74*b*, the forces applied to the bell crank mechanisms 74*a*, 74*b* by the steering assist device 42 are no longer in alignment with the central pivot points 45. As such, these forces, which are represented by arrows $F_1$, $F_1'$, create a moment force on the bell crank mechanisms 74*a*, 74*b* tending to further push the bell crank mechanisms 74*a*, 74*b* in a counter clockwise direction.

As the bell crank mechanisms 74*a*, 74*b* rotate in the counter-clockwise direction, the linear distance between the ends of the arms 46 of the bell crank mechanisms 74*a*, 74*b* expand, thereby causing the steering assist device 42 to expand. As the steering assist device 42 expands its level of compression decreases and the force it exerts on the arms 46 also decreases. In the case where the monorail bogie 14 is travelling over a left curve having a θ curve radius, the steering assist device expands, wherein it provides a decreased outward force in comparison to the force it exerts in its compressed form. The fact that this force is now offset from the central pivot points 45 of the bell crank mechanisms 74*a*, 74*b* causes a moment force to be applied to the bell crank mechanisms 74*a*, 74*b*.

Figure 7A:
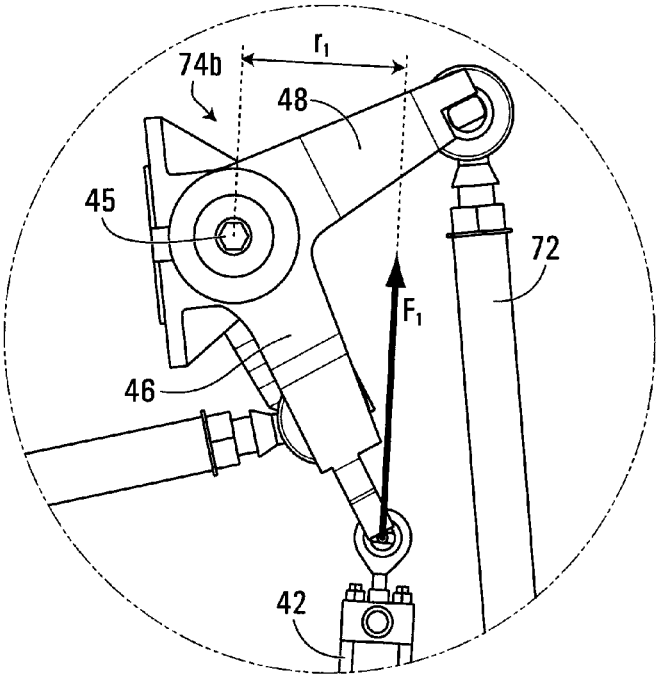
FIG. 7A shows an expanded view of one of the bell crank mechanisms shown in FIG. 6.
Figure 7B:
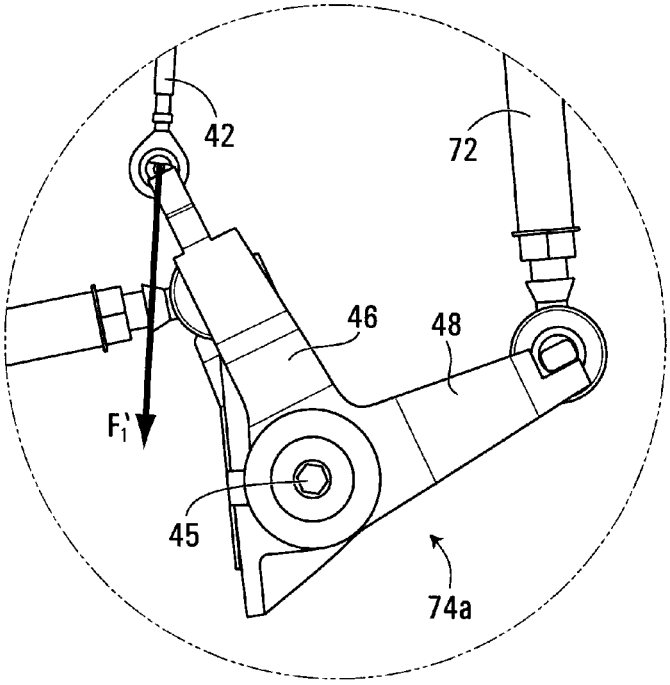
FIG. 7B shows an expanded view of the other bell crank mechanism shown in FIG. 6.

Shown in FIGS. 7A, 7B are expanded views of the bell crank mechanisms 74*a*, 74*b*, showing the forces applied to these bell crank mechanisms 74*a*, 74*b* by the steering assist device 42. The moment applied to the bell crank mechanisms 74*a*, 74*b* can be calculated by multiplying the Force ($F_1$ or $F_1'$) by the lever arm ($r_1$), which is the perpendicular distance between the Force vector and the central pivot point 45. Therefore, the moment can be calculated using the formula: $M=F_1*r_1$.

Referring back to FIG. 6, it can be seen that this counter-clockwise moment force that is applied to each of the bell crank mechanisms 74*a*, 74*b*, causes a force to be applied to each of the traction links 62*a*, 62*b*. More specifically, the rotation of the bell crank mechanism 74*b* in a counter-clockwise direction causes the traction link 62*b* to be pulled, while the rotation of the bell crank mechanism 74*a* in a counter-clockwise direction causes the traction link 62*a* to be pushed. This pulling and pushing of the traction links 62*b*, 62*s*, causes the shear force 92 to be applied to the monorail bogie 14, which cause rotation of the monorail bogie 14 in a clockwise direction around its center of gravity (CoG). This shear force 92 counter-acts the shear forces 90 imposed on the monorail bogie 14 by the secondary suspension thereby facilitating the rotational motion between the monorail bogie 14 and the monorail car 12, and causing the monorail bogie 14 to remain in better alignment with the monorail track 16. The better aligned the monorail bogie 14 is with the monorail track 16, the better the load distribution among the guide wheels 32. Moreover, if the monorail bogie 14 is well aligned with the monorail track 16, excessive additional loading on the outboard inner guide wheels is avoided.

By adjusting different parameters of the steering assist device 42, the shear force 92 that is applied to the monorail bogie 14 can be adjusted. For example, by modifying the length of the arms 46 of the bell crank mechanisms 74*a*, 74*b*, or by adjusting the stiffness or load exerted by the steering assist device 42, the amount of shear force 92 applied to the monorail bogie 14 can be changed. Therefore, it would be known to a person of skill in the art to adjust the steering assist device 42 in order to achieve a desired shear force 92 that adequately counters any shear force 90 applied by the secondary suspension arrangement.

It should be understood that the functioning of the steering assist device 42 of the present invention is passive, meaning that it works without an active control system. The steering assist device 42 works by responding to the changes in forces acting on the monorail bogie 14. The shear forces applied to the monorail bogie 14 as a result of the steering assist device 42 will vary depending on the radius of curvature of the monorail track 16. Furthermore, the steering assist device 42 of the present invention works regardless of the inboard or outboard position of the steering assist device 42 in relation to the monorail bogie 14. It also works regardless of the forward or backwards movement of the monorail bogie 14. This makes the steering assist device 42 of the present invention both simple and versatile.

Although the present invention has been described in considerable detail with reference to certain preferred embodiments thereof, variations and refinements are possible without departing from the spirit of the invention. Therefore, the scope of the invention should be limited only by the appended claims and their equivalents.

The invention claimed is:

1. A traction control assembly for connection between a monorail bogie frame and a monorail car, the traction control assembly comprising:

a) a first traction link pivotally connected to a first bell crank mechanism;

b) a second traction link pivotally connected to a second bell crank mechanism, the first traction link and the second traction link being capable of absorbing traction forces applied to the monorail bogie;

c) a cross link interconnecting the first bell crank mechanism and the second bell crank mechanism; and d) a steering assist device interconnecting the first bell crank mechanism and the second bell crank mechanism, the steering assist device causing the traction control assembly to apply shear forces to the monorail bogie during travel of the monorail bogie over a curved section of monorail track for facilitating rotational motion between the monorail bogie and the monorail car.

2. The traction control assembly as defined in claim 1, wherein the steering assist device is a passive steering assist device.

3. The traction control assembly as defined in claim 2, wherein the steering assist device is an active steering assist device.

4. The traction control assembly as defined in claim 1, wherein the first traction link and the second traction link are further pivotally connected to one of the monorail bogie and the monorail car.

5. The traction control assembly as defined in claim 1, wherein the steering assist device is positioned substantially parallel to the cross link during travel of the monorail bogie over a straight section of monorail track.

6. The traction control assembly as defined in claim 4, wherein during travel of the monorail bogie over a curved section of monorail track, the steering assist device causes moment forces to be exerted on the first and second bell crank mechanisms.

7. The traction control assembly as defined in claim 5, wherein the steering assist device expands in length for causing the moment forces to be exerted on the first and second bell crank mechanisms.

8. The traction control assembly as defined in claim 5, wherein the moment forces exerted on the first and second bell crank mechanisms cause the first traction link and the second traction link to insert the shear forces on the monorail bogie so as to counter shear forces exerted by a secondary suspension system positioned between the monorail bogie and the monorail car.

9. The traction control assembly as defined in claim 1, wherein the steering assist device comprises one of a helical spring, a hydraulic cylinder and a pneumatic cylinder.

10. The traction control assembly as defined in claim 1, further comprising a pitching control mechanism comprising:

a) a third traction link; and b) a linking member comprising a first end and a second end;

wherein the first end of the linking member is pivotally connected to the first bell crank mechanism and the second end of the linking member is pivotally connected to the third traction link.

11. The traction control assembly as defined in claim 10, wherein the linking member is positioned substantially perpendicularly to the first traction link and the third traction link.

12. A monorail bogie assembly for supporting a monorail car over a monorail track, the monorail bogie assembly comprising:

a) a monorail bogie body comprising a frame, at least one load bearing wheel, a first guide wheel on a first side of the frame, a second guide wheel on a second side of the frame and a first stabilising wheel on the first side of the frame;

b) a first traction link pivotally connected to a first bell crank mechanism;

c) a second traction link pivotally connected to a second bell crank mechanism, the first traction link and the second traction link being capable of absorbing traction forces applied to the monorail bogie;

d) a cross link interconnecting the first bell crank mechanism and the second bell crank mechanism; and e) a steering assist device interconnecting the first bell crank mechanism and the second bell crank mechanism, the steering assist device causing the traction control assembly to insert shear forces on the monorail bogie during travel of the monorail bogie over a curved section of monorail track for facilitating rotational motion between the monorail bogie and the monorail car.

13. The monorail bogie assembly as defined in claim 12, wherein the steering assist device is a passive steering assist device.

14. The monorail bogie assembly as defined in claim 12, wherein the steering assist device is an active steering assist device.

15. The monorail bogie assembly as defined in claim 12, wherein the first traction link and the second traction link are further pivotally connected to one of the monorail bogie and the monorail car.

16. The monorail bogie assembly as defined in claim 12, wherein the steering assist device is positioned substantially parallel to the cross link during travel of the monorail bogie over a straight section of monorail track.

17. The monorail bogie assembly as defined in claim 15, wherein during travel of the monorail bogie over a curved section of monorail track, the steering assist device causes moment forces to be exerted on the first and second bell crank mechanisms.

18. The monorail bogie assembly as defined in claim 17, wherein the steering assist device expands in length for causing the moment forces to be exerted on the first and second bell crank mechanisms.

19. The monorail bogie assembly as defined in claim 18, wherein the moment forces exerted on the first and second bell crank mechanisms cause the first traction link and the second traction link to insert shear forces on the monorail bogie that counter shear forces exerted by a secondary suspension system positioned between the monorail bogie and the monorail car.

20. The monorail bogie assembly as defined in claim 12, wherein the steering assist device comprises one of a helical spring, a hydraulic cylinder and a pneumatic cylinder.

21. The monorail bogie assembly as defined in claim 12, further comprising a pitching control mechanism comprising:

a) a third traction link; and b) a linking member comprising a first end and a second end;

wherein the first end of the linking member is pivotally connected to the first bell to the crank mechanism and the second end of the linking member is pivotally connected third traction link.

22. The monorail bogie assembly as defined in claim 21, wherein the linking member is positioned substantially perpendicularly to the first traction link and the third traction link.

23. A method of operation of a steering assist device, the steering assist device being part of a monorail bogie supporting a monorail car, the steering assist device being pivotally connected to a first bell crank mechanism and a second bell crank mechanism that connect the monorail bogie to the monorail car via first and second traction links, the method comprising:

i) during travel of the monorail bogie over a curved section of monorail track, the steering assist device exerting a moment on the first and second bell crank mechanism for causing the first and second traction links to insert shear forces for countering shear forces created by a suspension system;

ii) during travel of the monorail bogie over a straight section of monorail track, the steering assist device is in line with the first and second bell crank mechanisms so that no moment is exerted on the first and second bell crank mechanisms.

* * * * *